US010156821B1

(12) United States Patent
Yuge

(10) Patent No.: US 10,156,821 B1
(45) Date of Patent: Dec. 18, 2018

(54) IMAGE FORMING APPARATUS AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Keiji Yuge, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/711,062

(22) Filed: Sep. 21, 2017

(51) Int. Cl.
*G03G 15/20* (2006.01)
*G03G 15/08* (2006.01)
*G03G 15/00* (2006.01)

(52) U.S. Cl.
CPC ..... *G03G 15/2053* (2013.01); *G03G 15/2042* (2013.01); *G03G 15/2064* (2013.01); *G03G 15/0822* (2013.01); *G03G 15/5033* (2013.01)

(58) Field of Classification Search
CPC ..... G03G 15/2042
See application file for complete search history.

(56) References Cited

U.S. PATENT DOCUMENTS 5,991,565 A * 11/1999 Hanyu ..... G03G 15/2042 399/328
6,047,158 A * 4/2000 Morigami ..... G03G 15/2042 219/216
6,298,215 B1 * 10/2001 Nomura ..... H05B 6/145 219/619
7,122,769 B2 * 10/2006 Nami ..... G03G 15/2042 219/619
9,696,680 B2 7/2017 Kawasaki et al.
2002/0118982 A1 * 8/2002 Fuma ..... G03G 15/2042 399/329
2005/0078990 A1 * 4/2005 Shiraishi ..... G03G 15/2042 399/329
2006/0177250 A1 * 8/2006 Nakagaki ..... G03G 15/2064 399/328

(Continued)

FOREIGN PATENT DOCUMENTS

JP 2003-248360 9/2003

*Primary Examiner* — Sevan A Aydin
(74) *Attorney, Agent, or Firm* — Amin, Turocy & Watson LLP

(57) ABSTRACT

An image forming apparatus comprises a first sensor configured to measure a first temperature indicating a surface temperature of an endless belt for fixing a developing agent adhering to a sheet; a second sensor configured to measure a second temperature indicating a surface temperature of an end part of the endless belt; an atmosphere temperature measurement sensor configured to measure an atmosphere temperature indicating a temperature around the image forming apparatus; a threshold value temperature determination section configured to determine, based on the atmosphere temperature and the first temperature, an abutting condition as a condition under which a heat conduction member for executing temperature equalization of the surface temperature of the endless belt abuts against the endless belt; and a heat conduction member control section configured to enable the heat conduction member to abut against the endless belt if the second temperature meets the abutting condition.

10 Claims, 7 Drawing Sheets

(56) References Cited

U.S. PATENT DOCUMENTS

| | | | | |
|---|---|---|---|---|
| 2013/0058673 | A1* | 3/2013 | Kikkawa | G03G 15/2042 399/69 |
| 2013/0136480 | A1* | 5/2013 | Hasegawa | G03G 15/2039 399/69 |
| 2013/0188978 | A1* | 7/2013 | Takeuchi | G03G 15/2042 399/69 |
| 2016/0216664 | A1* | 7/2016 | Yagi | G03G 15/2039 |

* cited by examiner

| EXAMPLE NO. | | 1 | 2 | 3 | SUPPLEMENT |
|---|---|---|---|---|---|
| TEMPERATURE OF THERMOPILE SENSOR t0℃ | | 160 | 160 | 160 | CENTRAL TEMPERATURE OF ENDLESS BELT |
| FIRST TEMPERATURE MEASUREMENT SENSOR | ATMOSPHERE TEMPERATURE(℃) | 80 | 80 | 110 | IS ATMOSPHERE TEMPERATURE SMALLER THAN 100 DEGREES CENTIGRADE? → YES: ADDING SECOND ΔTEMPERATURE |
| | ADDING OF ΔTEMPERATURE WITH t0(Δa) | Δ30 | Δ30 | Δ15 | FIRST ΔTEMPERATURE OF 15 DEGREES CENTIGRADE, SECOND ΔTEMPERATURE OF 30 DEGREES CENTIGRADE |
| | ABUTTING THRESHOLD VALUE a(t0+Δa) | 190 | 190 | 175 | |
| | a SURFACE TEMPERATURE OF ENDLESS BELT(℃) | 185 | 195 | 185 | |
| | ABUTTING DETERMINATION a | INVALID a | INVALID a | INVALID a | a IS SURFACE TEMPERATURE OF ENDLESS BELT SMALLER THAN t0+Δa DEGREES CENTIGRADE? → NO: DETERMINATION OF EXECUTION |
| SECOND TEMPERATURE MEASUREMENT SENSOR | ATMOSPHERE TEMPERATURE(℃) | 80 | 80 | 110 | IS ATMOSPHERE TEMPERATURE SMALLER THAN 100 DEGREES CENTIGRADE? → NO: ADDING SECOND ΔTEMPERATURE |
| | ADDING OF ΔTEMPERATURE WITH t0(Δb) | Δ30 | Δ30 | Δ15 | FIRST ΔTEMPERATURE OF 15 DEGREES CENTIGRADE, SECOND ΔTEMPERATURE OF 30 DEGREES CENTIGRADE |
| | ABUTTING THRESHOLD VALUE b(t0+Δb) | 190 | 190 | 175 | |
| | b SURFACE TEMPERATURE OF ENDLESS BELT(℃) | 175 | 175 | 175 | |
| | ABUTTING DETERMINATION b | INVALID b | INVALID b | EXECUTION b | b IS SURFACE TEMPERATURE OF ENDLESS BELT SMALLER THAN t0+Δb DEGREES CENTIGRADE? → NO: DETERMINATION OF EXECUTION |
| FINAL DETERMINATION OF ABUTMENT OF PIPE-SHAPED HEAT CONDUCTION MEMBER | | INVALID | EXECUTION | EXECUTION | IS THERE DETERMINATION OF EXECUTION IN ONE OF FIRST TEMPERATURE MEASUREMENT SENSOR AND SECOND TEMPERATURE MEASUREMENT SENSOR |

FIG.8

IMAGE FORMING APPARATUS AND IMAGE FORMING METHOD

FIELD

Embodiments described herein relate generally to an image forming apparatus and an image forming method

BACKGROUND

With respect to a fixing section included in an image forming apparatus, a thermopile sensor measures a surface temperature of an endless belt included in the fixing section. A pipe-shaped heat conduction member abuts against the endless belt depending on the measured temperature. In this way, temperature equalization of the surface temperature of the endless belt is achieved. However, since a plurality of thermopile sensors is arranged in a longitudinal direction of the fixing section, the cost becomes high. Further, there is a case in which power consumption is increased since the pipe-shaped heat conduction member decreases the surface temperature of the endless belt.

BRIEF DESCRIPTION OF THE DRAWINGS

FIG. 8 is a diagram illustrating an execution result of a method for reducing temperature increase of an end part of the endless belt 304 according to the embodiment.

DETAILED DESCRIPTION

In accordance with an embodiment, an image forming apparatus comprises a first temperature measurement sensor, a second temperature measurement sensor, an atmosphere temperature measurement sensor, a threshold value temperature determination section, and a heat conduction member control section. The first temperature measurement sensor measures a first temperature indicating a surface temperature of an endless belt for fixing a developing agent adhering to a sheet. The second temperature measurement sensor measures a second temperature indicating a surface temperature of an end part of the endless belt. The atmosphere temperature measurement sensor measures an atmosphere temperature indicating a temperature around the image forming apparatus. The threshold value temperature determination section determines, on the basis of the atmosphere temperature and the first temperature, an abutting condition serving as a condition under which a heat conduction member for carrying out temperature equalization of the surface temperature of the endless belt abuts against the endless belt.

The heat conduction member control section enables the heat conduction member to abut against the endless belt in a case in which the second temperature meets the abutting condition.

Figure 1:
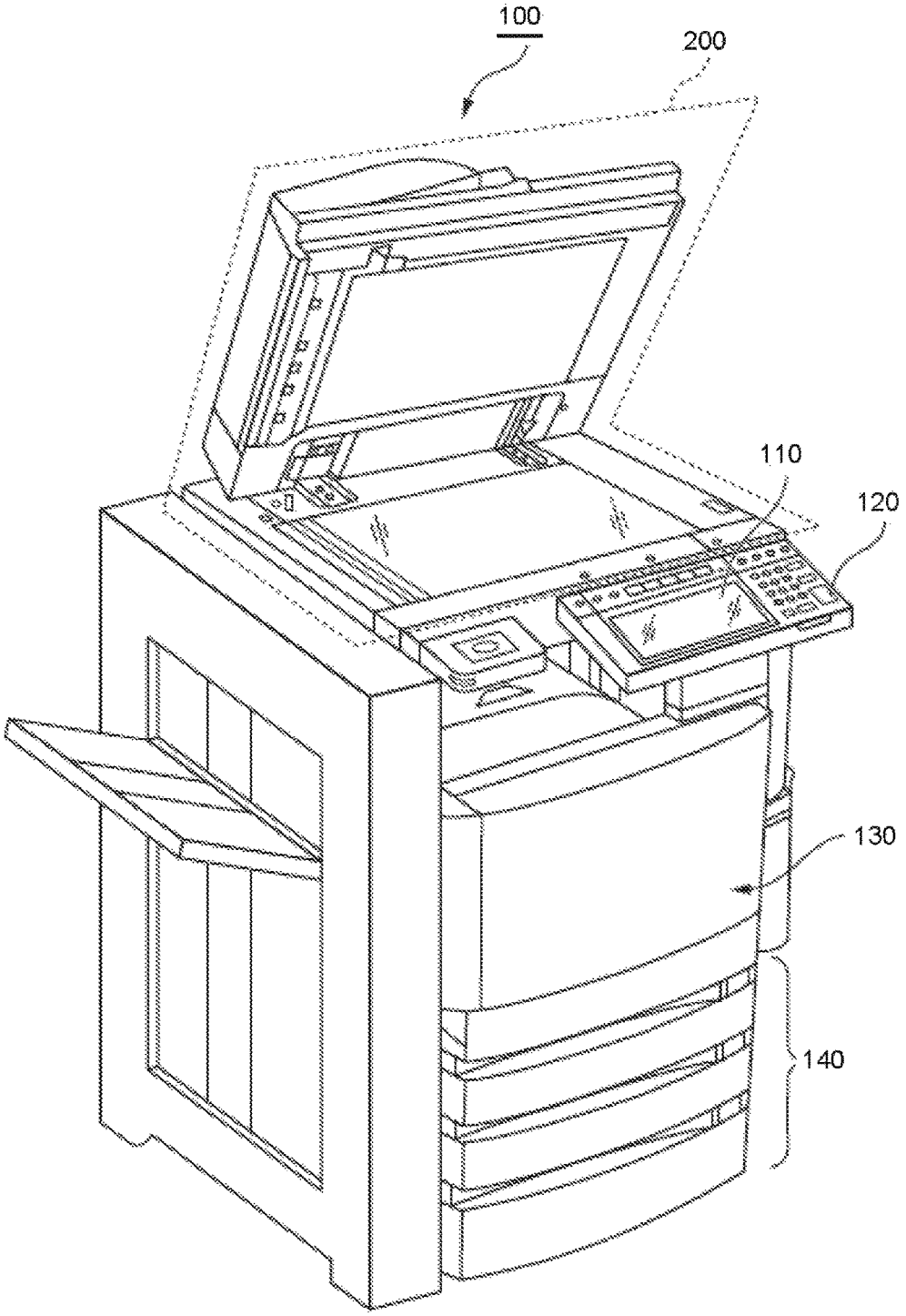
FIG. 1 is an external view of an image forming apparatus.

FIG. 1 is an external view illustrating an example of an entire constitution of an image forming apparatus 100 according to an embodiment. The image forming apparatus 100 is, for example, a multi-functional peripheral. The image forming apparatus 100 includes a display 110, a control panel 120, a printer section 130, a sheet housing section 140, and an image reading section 200. Furthermore, the printer section 130 of the image forming apparatus 100 may be a device for fixing a toner image.

The image forming apparatus 100 forms an image on a sheet with a developing agent such as toner. The sheet is, for example, a paper or a label paper. The sheet may be an optional sheet as long as the image forming apparatus 100 can form an image on the surface of the sheet.

The display 110 is an image display device such as a liquid crystal display, an organic EL (Electro Luminescence) display and the like. The display 110 displays various kinds of information relating to the image forming apparatus 100.

The control panel 120 has a plurality of buttons. The control panel 120 receives an operation of a user. The control panel 120 outputs a signal corresponding to an operation carried out by the user to a control section of the image forming apparatus 100. Furthermore, the display 110 and the control panel 120 can be separate or both may be integrated into a single touch panel.

The printer section 130 forms an image on a sheet on the basis of image information generated by the image reading section 200 or image information received via a communication path. The printer section 130 forms the image through, for example, the following processing. The image forming section of the printer section 130 forms an electrostatic latent image on a photoconductive drum on the basis of the image information. The image forming section of the printer section 130 enables a developing agent to adhere to the electrostatic latent image to form a visible image. As a concrete example of the developing agent, toner is exemplified. The transfer section of the printer section 130 transfers the visible image on the sheet. The fixing section of the printer section 130 heats and pressures the sheet to enable the visible image to be fixed on the sheet. Furthermore, the sheet on which the image is formed may be a sheet housed in the sheet housing section 140 or a manually fed sheet.

The sheet housing section 140 houses a sheet used for printing by the printer section 130.

The image reading section 200 reads the image information of a read object as intensity of light. The image reading section 200 records the read image information. The recorded image information may be sent to another information processing apparatus via a network. The recorded image information may be printed on the sheet by the printer section 130.

Figure 2:
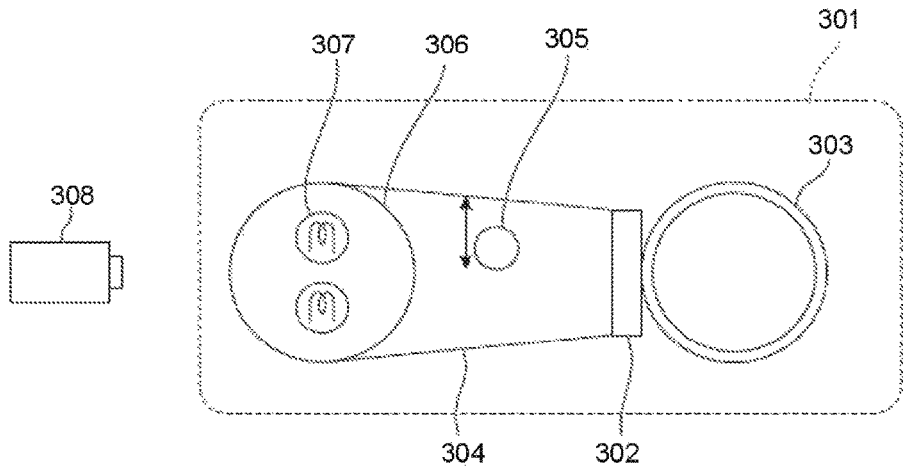
FIG. 2 is a diagram of a fixing section.

FIG. 2 is a diagram illustrating one concrete example of a constitution of a fixing section 301 according to the embodiment. The fixing section 301 includes a nip forming member 302, a pressure roller 303, an endless belt 304, a pipe-shaped heat conduction member 305, a cylinder-shaped roller 306 and a heat source lamp 307. A thermopile sensor 308 is arranged at a position opposite to a longitudinal direction of the fixing section 301.

The nip forming member 302 is arranged opposed to the pressure roller 303. The nip forming member 302 forms a fixing nip between the nip forming member 302 and the pressure roller 303. The nip forming member 302 and the pressure roller 303 melt and fix the developing agent if a sheet fixed with the developing agent passes to a position between the nip forming member 302 and the pressure roller 303.

The endless belt 304 enables the sheet to pass through a position between the nip forming member 302 and the pressure roller 303 through rotation. The pipe-shaped heat conduction member 305 is arranged inside the endless belt 304. The endless belt 304 melts the developing agent adhering to the sheet through a surface temperature.

The pipe-shaped heat conduction member 305 carries out temperature equalization of the surface temperature of the endless belt 304 by abutting against or being separate from the endless belt 304. The pipe-shaped heat conduction member 305 is composed of, for example, a heat pipe.

The cylinder-shaped roller 306 rotatably supports the endless belt 304 included in the fixing section 301. The cylinder-shaped roller 306 includes the heat source lamp 307 therein as a heat source. The heat source lamp 307 generates heat in such a manner that a light emitting filament 307*a* emits light. The heat source lamp 307 generates the heat such that the surface temperature of the endless belt 304 is increased.

Figure 3:
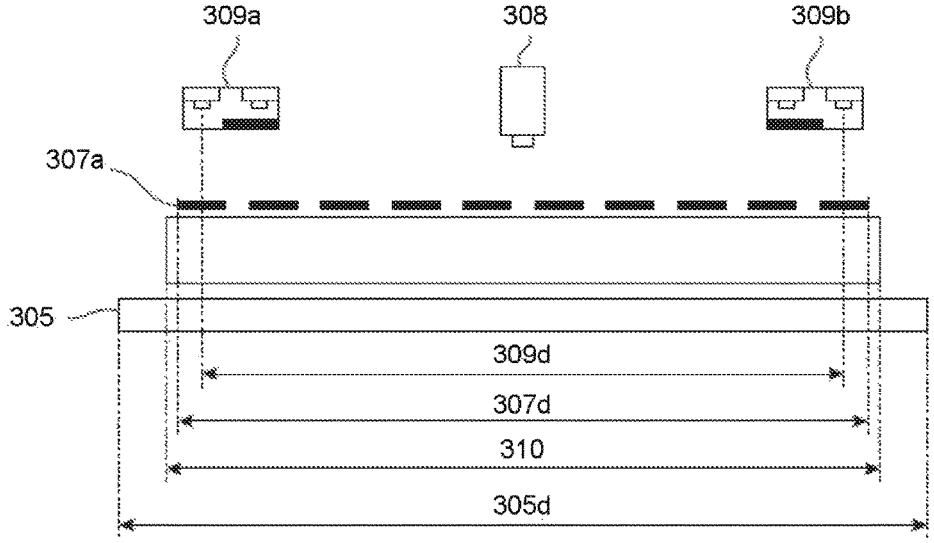
FIG. 3 is a diagram of a thermopile sensor and a temperature measurement sensor.

FIG. 3 is a diagram illustrating one concrete example of arrangements of the thermopile sensor 308 and the temperature measurement sensor 309 according to the embodiment. The temperature measurement sensor 309 measures a surface temperature of an end part of the endless belt 304 by utilizing an infrared absorption difference. The thermopile sensor 308 is arranged opposite to the central portion of the endless belt 304 in a longitudinal direction. The image forming apparatus 100 includes a first temperature measurement sensor 309*a* arranged opposite to a left end part of the endless belt 304 and a second temperature measurement sensor 309*b* arranged opposite to a right end part of the endless belt 304 as temperature measurement sensors 309. An arrow 309*d* represents a distance between the first temperature measurement sensor 309*a* and the second temperature measurement sensor 309*b*. Hereinafter, when not distinguished, the first temperature measurement sensor 309*a* or the second temperature measurement sensor 309*b* is simply referred to as a temperature measurement sensor 309 to be described.

An arrow 307*d* represents a positional relationship between the light emitting filament 307*a* and other members. According to the arrow 307*d*, each of the temperature measurement sensors 309 is arranged at the inside of the light emitting filament 307*a*.

An arrow 310 represents a positional relationship in which a sheet having a maximum sheet width (hereinafter, referred to as a "maximum paper width") used in the image forming apparatus 100 passes. According to the arrow 310, a length of the light emitting filament 307*a* is shorter than a length of the maximum paper width used in the image forming apparatus 100.

An arrow 305*d* represents a positional relationship of the pipe-shaped heat conduction member 305. The pipe-shaped heat conduction member 305 is arranged to the outside of the light emitting filament 307*a* to be constituted such that temperature increase of the end part of the endless belt 304 is suppressed.

Herein, for example, a case in which a sheet of A3 size is set to the maximum paper width is described. The width of the light emitting filament 307*a* is arranged inside the maximum paper width. Therefore, in a case in which the image forming apparatus 100 continuously prints sheets of A3 size, the increase of the surface temperature of the end part of the endless belt 304 is difficult to occur. On the contrary, in a case in which sheets of a narrower width than the maximum paper width such as B4 size or A5-R size are continuously printed, a surface temperature of a non-paper passing part is easy to increase. Thus, on the basis of a difference between measured temperatures of the thermopile sensor 308 and the temperature measurement sensor 309, the temperature increase of the non-paper passing part is suppressed by enabling the pipe-shaped heat conduction member 305 to abut against the endless belt 304.

In a case in which sheets having the maximum paper width pass by arranging members in this way, an temperature equalization operation achieved by enabling the pipe-shaped heat conduction member 305 to abut against the endless belt 304 can be suppressed. Further, in a case in which the temperature measurement sensor 309 detects the increase of the surface temperature of the end part of the endless belt 304, the temperature equalization of the surface temperature of the end part of the endless belt 304 can be carried out by enabling the pipe-shaped heat conduction member 305 to abut against the endless belt 304.

Figure 4:
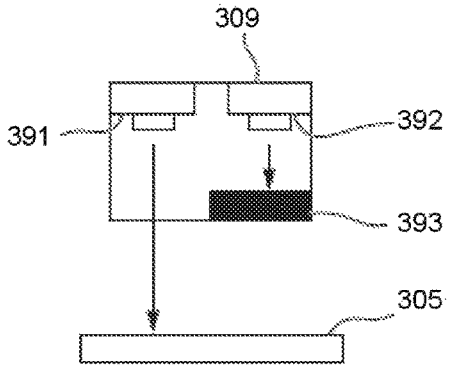
FIG. 4 is a diagram of the temperature measurement sensor.

FIG. 4 is a diagram illustrating a constitution of the temperature measurement sensor 309 according to the embodiment. The temperature measurement sensor 309 includes a belt temperature sensor 391, an atmosphere temperature sensor 392 and a reference member for atmosphere temperature measurement 393.

The temperature measurement sensor 309 emits infrared rays to the endless belt 304 and the reference member for atmosphere temperature measurement 393, and measures a temperature by utilizing the infrared absorption difference. Specifically, the belt temperature sensor 391 measures a surface temperature of the endless belt 304 by emitting infrared rays to the endless belt 304. The atmosphere temperature sensor 392 measures an atmosphere temperature by emitting infrared rays to the reference member for atmosphere temperature measurement 393. The atmosphere temperature is a temperature around the temperature measurement sensor 309.

The belt temperature sensor 391 is one form of a second temperature measurement sensor. The second temperature measurement sensor measures a second temperature indicating the surface temperature of the end part of the endless belt and an atmosphere temperature indicating a temperature around the image forming apparatus.

Furthermore, the belt temperature sensor 391 and the atmosphere temperature sensor 392 may be included in different devices or in the same device.

Figure 5:
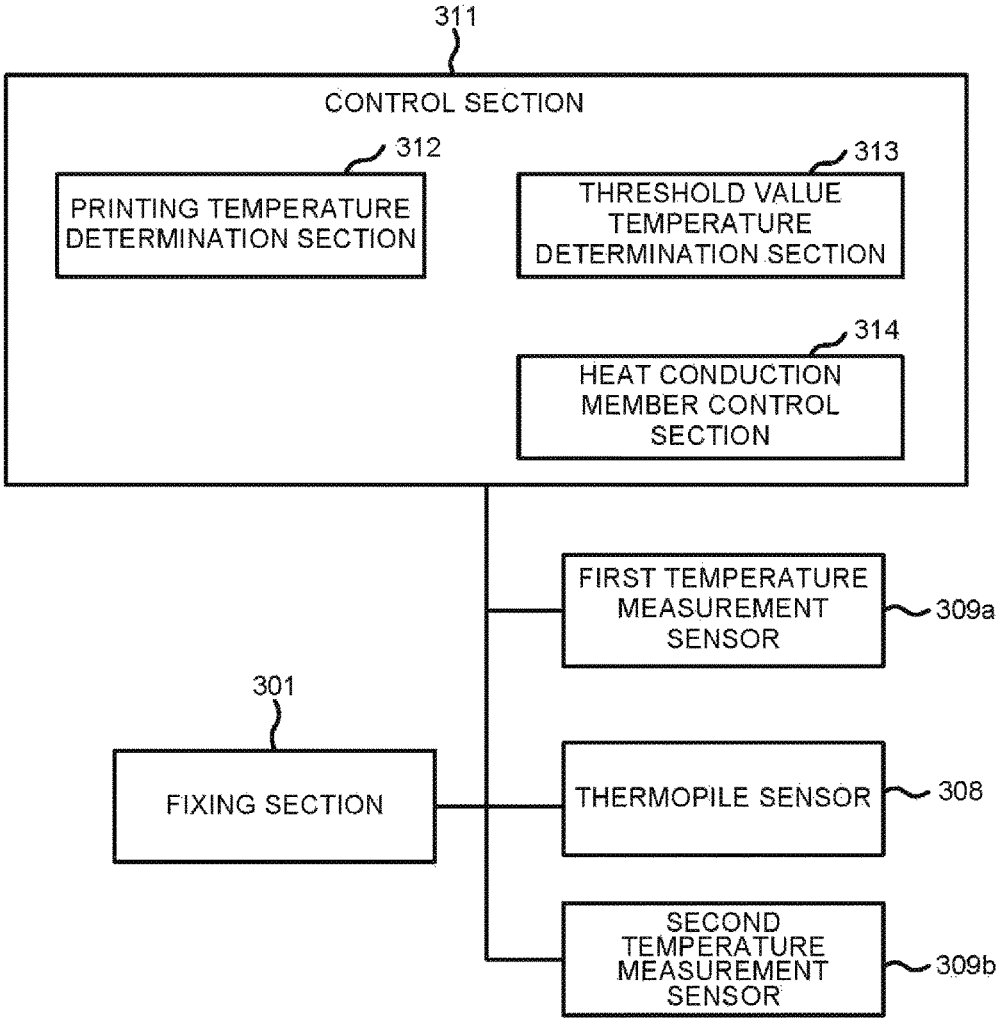
FIG. 5 is a functional block diagram of the image forming apparatus.

FIG. 5 is a functional block diagram illustrating functional components of the image forming apparatus 100 according to the embodiment. The image forming apparatus 100 includes the fixing section 301, the thermopile sensor 308, the first temperature measurement sensor 309*a*, the second temperature measurement sensor 309*b* and a control section 311.

The fixing section 301 melts the developing agent adhering to the sheet and fixes the developing agent on the sheet. The thermopile sensor 308 measures the surface temperature of the endless belt 304 by a thermopile system. The thermopile sensor 308 is one form of a first temperature measurement sensor. The first temperature measurement sensor measures a first temperature indicating the surface temperature of the endless belt 304 for melting the developing agent adhering to the sheet.

The first temperature measurement sensor 309*a* measures a surface temperature of an end part of the endless belt 304.

The first temperature measurement sensor 309*a* measures the atmosphere temperature. The first temperature measurement sensor 309*a* is arranged opposite to a left end part of the endless belt 304 in the longitudinal direction.

The second temperature measurement sensor 309*b* measures a surface temperature of an end part of the endless belt 304. The second temperature measurement sensor 309*b* measures the atmosphere temperature. The second temperature measurement sensor 309*b* is arranged opposite to a right end part of the endless belt 304 in the longitudinal direction.

The control section 311 controls operations of each section of the image forming apparatus 100. The control section 311 is executed by, for example, a device including a CPU (Central Processing Unit) for controlling the whole device and a RAM (Random Access Memory). The control section 311 functions as a printing temperature determination section 312, a threshold value temperature determination section 313 and a heat conduction member control section 314 by executing an image forming program.

The printing temperature determination section 312 determines whether or not the surface temperature of the endless belt 304 is a printing permission temperature. The printing permission temperature is a temperature at which a printing processing can be carried out. The temperature at which the printing processing can be carried out is, for example, a melting point of the developing agent such as 160 degrees centigrade.

The threshold value temperature determination section 313 determines an abutting threshold value indicating a temperature which serves as a condition under which the pipe-shaped heat conduction member 305 abuts against the endless belt 304. The threshold value temperature determination section 313 determines the abutting threshold value by adding a predetermined temperature to the temperature measured by the thermopile sensor 308. The predetermined temperature is determined according to whether the measured atmosphere temperature is greater than or equal to an atmosphere temperature threshold value. For example, the threshold value temperature determination section 313 determines the abutting threshold value by adding a first Δtemperature to the surface temperature of the endless belt 304 measured by the thermopile sensor 308 in a case in which the measured atmosphere temperature is greater than or equal to the atmosphere temperature threshold value. The threshold value temperature determination section 313 determines the abutting threshold value by adding a second Δtemperature to the surface temperature of the endless belt 304 measured by the thermopile sensor 308 in a case in which the measured atmosphere temperature is smaller than the atmosphere temperature threshold value.

The heat conduction member control section 314 determines that abutment of the pipe-shaped heat conduction member 305 is executed if one surface temperature of the surface temperatures measured by the belt temperature sensor 391 meets an abutting condition. The abutting condition may be, for example, a case in which the surface temperature is greater than or equal to the abutting threshold value. The heat conduction member control section 314 controls to enable the pipe-shaped heat conduction member 305 to abut against the endless belt 304 if determining the abutment of the pipe-shaped heat conduction member 305 is executed.

Figure 6:
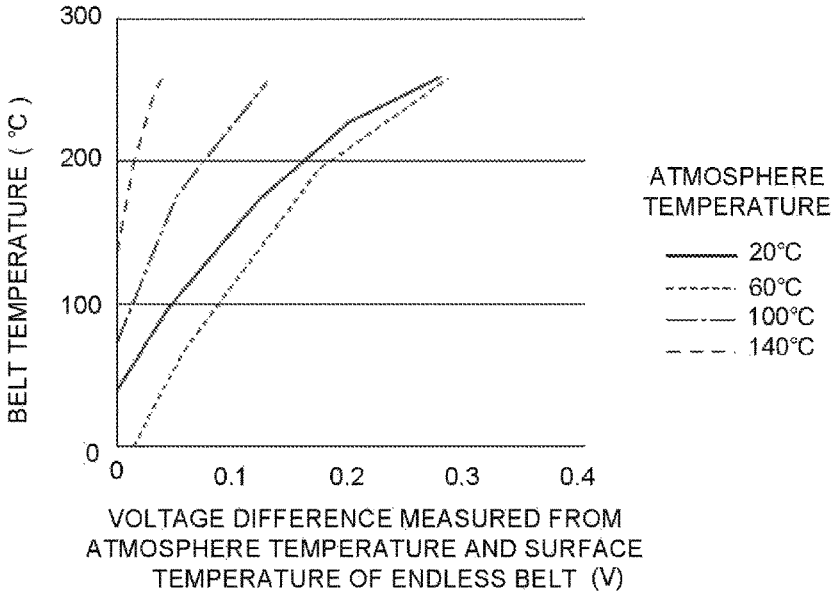
FIG. 6 is a diagram illustrating a relationship between a surface temperature of an endless belt and a voltage difference.

FIG. 6 is a diagram illustrating a relationship between the surface temperature of the endless belt and a voltage difference measured from the atmosphere temperature and the surface temperature of the endless belt 304 according to the embodiment. The vertical axis represents the surface temperature of the endless belt 304 measured by the belt temperature sensor 391. The horizontal axis represents the voltage difference measured from the atmosphere temperature and the surface temperature of the endless belt 304 (hereinafter, referred to as a "voltage difference"). It is understood from FIG. 6 that the higher the atmosphere temperature becomes, the smaller variation of the voltage difference based on the surface temperature of the endless belt 304 becomes. Further, in a case in which the reference member for atmosphere temperature measurement 393 generates a difference from the actual atmosphere temperature, the measurement accuracy of the surface temperature is decreased.

Figure 7:
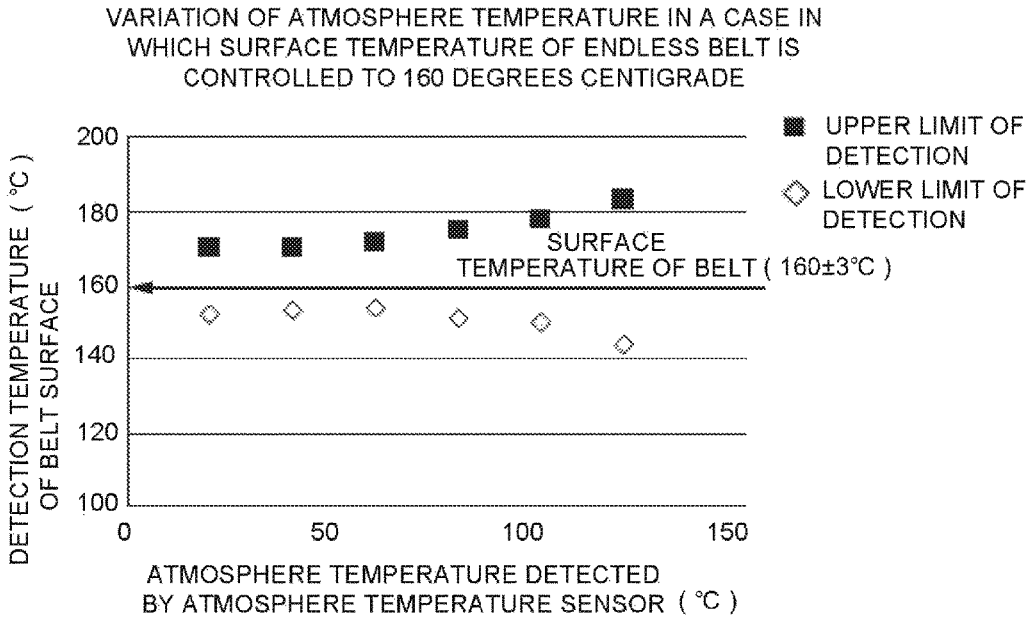
FIG. 7 is a diagram illustrating variation of the atmosphere temperature.

FIG. 7 is a diagram illustrating variation of the atmosphere temperature in a case in which the surface temperature of the endless belt 304 is controlled to 160 degrees centigrade according to the embodiment. The vertical axis represents the surface temperature of the endless belt 304 measured by the belt temperature sensor 391. The horizontal axis represents the atmosphere temperature measured by the atmosphere temperature sensor 392. In FIG. 7, as a printing condition, the image forming apparatus 100 starts printing by either cold standby or hot standby. As another printing condition, the image forming apparatus 100 starts printing by either continuous printing or intermittent printing. The heat conduction member control section 314 controls the temperature equalization of the surface temperature of the endless belt 304 on the basis of the temperature detected by the thermopile sensor 308 in the printing processing. Specifically, the fixing section 301 carries out a continuous printing processing in which start and stop of the printing processing are repeated under a condition that a contact type thermocouple and the temperature measurement sensor 309 are arranged in phase at end parts of the endless belt 304. It is understood from FIG. 7 that it is possible to generate a different between a measured value of the contact type thermocouple disposed in order to measure the surface temperature of the endless belt 304 and a measured value of the temperature measurement sensor 309 in a case in which away used in such a manner as to increase the atmosphere temperature is carried out in the image forming apparatus 100.

FIG. 8 is a diagram illustrating an execution result of a method for reducing the temperature increase of the end part of the endless belt 304 according to the embodiment. In the embodiment, the threshold value temperature determination section 313 determines the abutting threshold value of the pipe-shaped heat conduction member 305 on the basis of the measured temperature by the thermopile sensor 308 and the atmosphere temperature by the atmosphere temperature sensor 392. In the embodiment, the heat conduction member control section 314 controls the abutment or non-abutment of the pipe-shaped heat conduction member 305 on the basis of the determined abutting threshold value and the surface temperature of the end part of the endless belt 304 by the belt temperature sensor 391.

In FIG. 8, execution results of three examples are shown. In the execution results shown in FIG. 8, the atmosphere temperature threshold value is 100 degrees centigrade. The first Δtemperature is 15 degrees centigrade. The second Δtemperature is 30 degrees centigrade. Further, the surface temperatures of the endless belt 304 measured by the thermopile sensor 308 each are 160 degrees centigrade.

First Example

In the first example (example No. 1), the atmosphere temperature measured by the first temperature measurement sensor 309*a* is 80 degrees centigrade. The atmosphere temperature is smaller than the threshold value. Therefore, the threshold value temperature determination section 313 adds the second Δtemperature to the surface temperature of the endless belt 304 measured by the thermopile sensor 308. The threshold value temperature determination section 313 determines the abutting threshold value to 190 degrees centigrade. The surface temperature of the end part of the endless belt 304 measured by a belt temperature sensor 391*a* is 185 degrees centigrade. Since the surface temperature is smaller than the abutting threshold value, the heat conduction member control section 314 determines that the abutment of the pipe-shaped heat conduction member 305 is invalid.

In the first example, the atmosphere temperature measured by the second temperature measurement sensor 309*b* is 80 degrees centigrade. The atmosphere temperature is smaller than the threshold value. Therefore, the threshold value temperature determination section 313 adds the second Δtemperature to the surface temperature of the endless belt 304 measured by the thermopile sensor 308. The threshold value temperature determination section 313 determines the abutting threshold value to 190 degrees centigrade. The surface temperature of the end part of the endless belt 304 measured by a belt temperature sensor 391*b* is 175 degrees centigrade. Since the surface temperature is smaller than the abutting threshold value, the heat conduction member control section 314 determines that the abutment of the pipe-shaped heat conduction member 305 is invalid.

The heat conduction member control section 314 determines that the pipe-shaped heat conduction member 305 does not abut against the endless belt 304 since any determination result is invalid.

Second Example

In the second example (example No. 2), the atmosphere temperature measured by the first temperature measurement sensor 309*a* is 80 degrees centigrade. The atmosphere temperature is smaller than the threshold value. Therefore, the threshold value temperature determination section 313 adds the second Δtemperature to the surface temperature of the endless belt 304 measured by the thermopile sensor 308. The threshold value temperature determination section 313 determines the abutting threshold value to 190 degrees centigrade. The surface temperature of the end part of the endless belt 304 measured by the belt temperature sensor 391*a* is 195 degrees centigrade. Since the surface temperature is greater than or equal to the abutting threshold value, the heat conduction member control section 314 determines that the abutment of the pipe-shaped heat conduction member 305 is executed.

In the second example, the atmosphere temperature measured by the second temperature measurement sensor 309*b* is 80 degrees centigrade. The atmosphere temperature is smaller than the threshold value. Therefore, the threshold value temperature determination section 313 adds the second Δtemperature to the surface temperature of the endless belt 304 measured by the thermopile sensor 308. The threshold value temperature determination section 313 determines the abutting threshold value to 190 degrees centigrade. The surface temperature of the end part of the endless belt 304 measured by the belt temperature sensor 391*b* is 175 degrees centigrade. Since the surface temperature is smaller than the abutting threshold value, the heat conduction member control section 314 determines that the abutment of the pipe-shaped heat conduction member 305 is invalid.

The heat conduction member control section 314 determines that the pipe-shaped heat conduction member 305 abuts against the endless belt 304 since one determination result is executed.

Third Example

In the third example (example No. 3), the atmosphere temperature measured by the first temperature measurement sensor 309*a* is 110 degrees centigrade. The atmosphere temperature is greater than or equal to the threshold value. Therefore, the threshold value temperature determination section 313 adds the first Δtemperature to the surface temperature of the endless belt 304 measured by the thermopile sensor 308. The threshold value temperature determination section 313 determines the abutting threshold value to 175 degrees centigrade. The surface temperature of the end part of the endless belt 304 measured by the belt temperature sensor 391*a* is 185 degrees centigrade. Since the surface temperature is greater than or equal to the abutting threshold value, the heat conduction member control section 314 determines that the abutment of the pipe-shaped heat conduction member 305 is executed.

In the third example, the atmosphere temperature measured by the second temperature measurement sensor 309*b* is 110 degrees centigrade. The atmosphere temperature is greater than or equal to the threshold value. Therefore, the threshold value temperature determination section 313 adds the first Δtemperature to the surface temperature of the endless belt 304 measured by the thermopile sensor 308. The threshold value temperature determination section 313 determines the abutting threshold value to 175 degrees centigrade. The surface temperature of the end part of the endless belt 304 measured by the belt temperature sensor 391*b* is 175 degrees centigrade. Since the surface temperature is greater than or equal to the abutting threshold value, the heat conduction member control section 314 determines that the abutment of the pipe-shaped heat conduction member 305 is executed.

The heat conduction member control section 314 determines that the pipe-shaped heat conduction member 305 abuts against the endless belt 304 since two determination results are executed.

The abutting threshold value of the pipe-shaped heat conduction member 305 is determined by the atmosphere temperature measured by the temperature measurement sensor 309. By such determination, a possibility can be excluded that the surface temperature of the end part of the endless belt 304 becomes higher as a difference of the measured temperatures.

Figure 9:
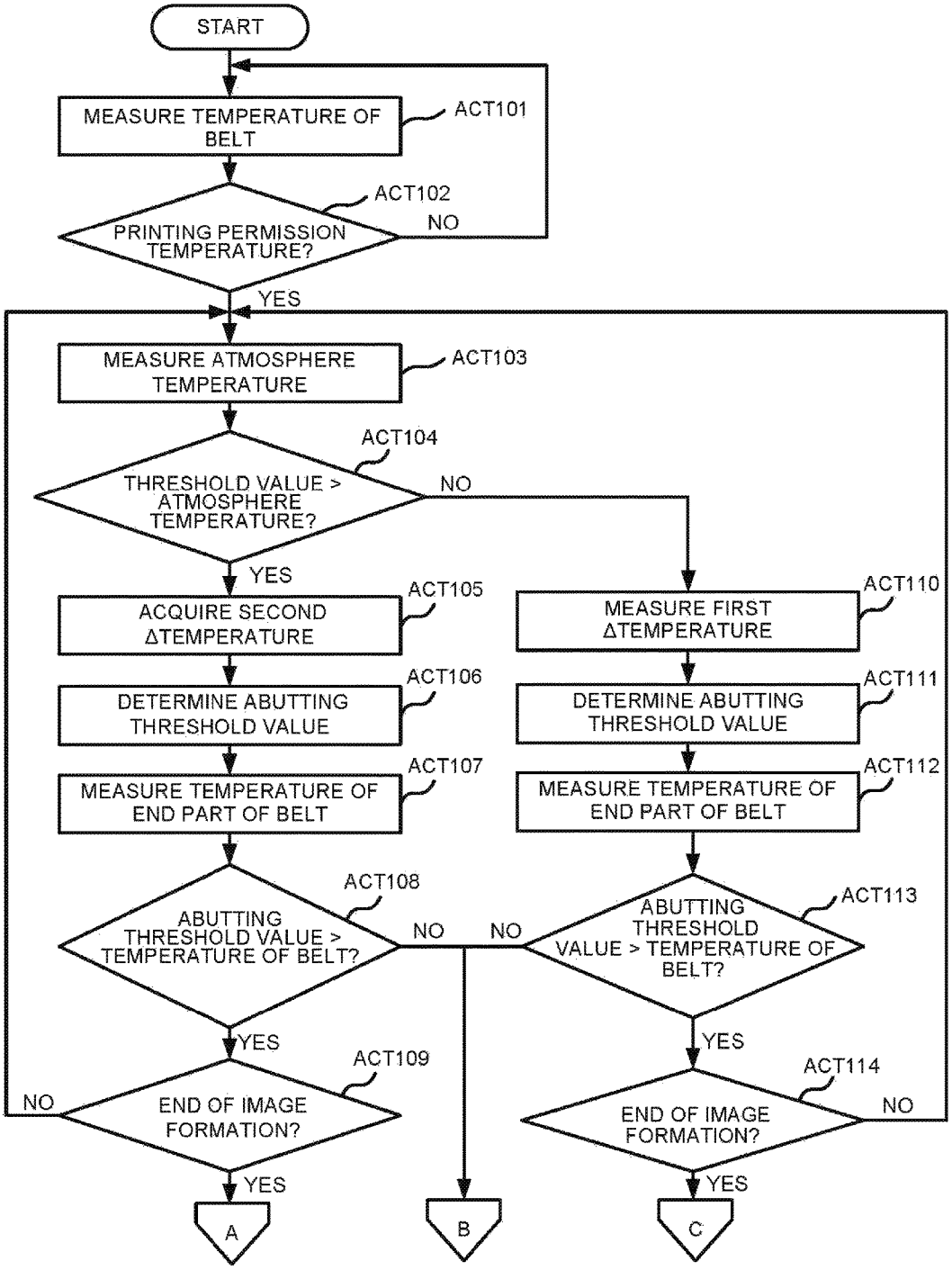
FIG. 9 is a flowchart of a pipe-shaped heat conduction member control according to the embodiment.
Figure 10:
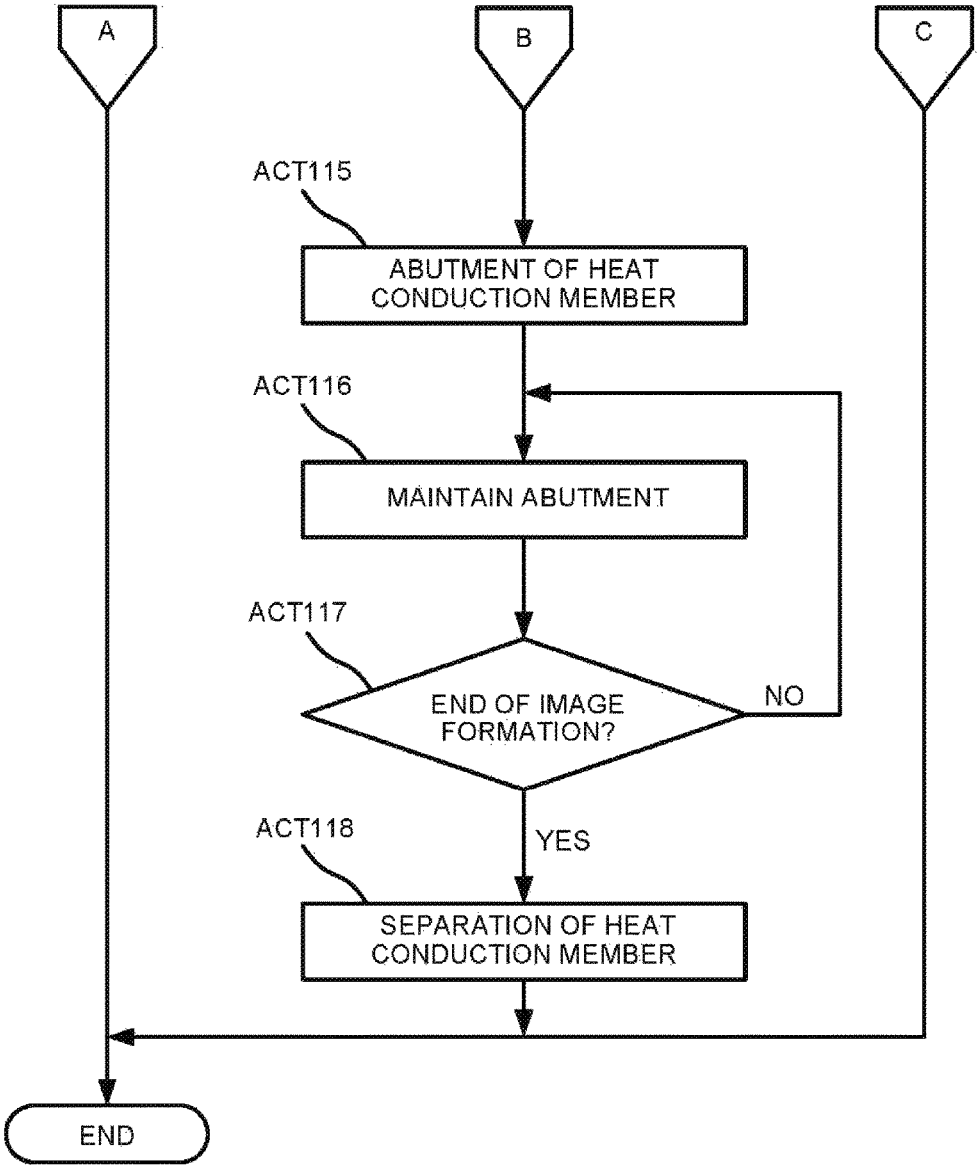
FIG. 10 is a flowchart of the pipe-shaped heat conduction member control according to the embodiment.

FIG. 9 and FIG. 10 are flowcharts illustrating a flow of a processing of the abutment or non-abutment of the pipe-shaped heat conduction member 305 according to the embodiment. The thermopile sensor 308 measures the surface temperature of the endless belt 304 (ACT 101). The printing temperature determination section 312 determines whether or not the measured temperature is the printing permission temperature (ACT 102). If the measured temperature is not the printing permission temperature (NO in ACT 102), the flow transits to the processing in ACT 101. If the measured temperature is the printing permission temperature (Yes in ACT 102), the atmosphere temperature sensor 392 measures the atmosphere temperature (ACT 103). The threshold value temperature determination section 313 determines whether or not the atmosphere temperature is smaller than the atmosphere temperature threshold value (ACT 104).

If the atmosphere temperature is smaller than the atmosphere temperature threshold value (Yes in ACT 104), processing from ACT 105 to ACT 109 is executed. The threshold value temperature determination section 313 acquires the second Δtemperature (ACT 105). The threshold value temperature determination section 313 determines the abutting threshold value by adding the temperature measured by the thermopile sensor 308 and the second Δtemperature (ACT 106). The belt temperature sensor 391 measures the surface temperature of the end part of the endless belt 304 (ACT 107). The heat conduction member control section 314 determines whether or not the surface temperature of the end part of the endless belt 304 is smaller than the abutting threshold value (ACT 108).

If the surface temperature of the end part of the endless belt 304 is not smaller than the abutting threshold value (NO in ACT 108), the flow transits to the processing in ACT 115. If the surface temperature of the end part of the endless belt 304 is smaller than the abutting threshold value (Yes in ACT 108), the control section 311 determines whether or not the printing processing is ended (ACT 109). If the printing processing is ended (Yes in ACT 109), the processing is ended. If the printing processing is not ended (NO in ACT 109), the flow transits to the processing in ACT 103.

If the atmosphere temperature is not smaller than the atmosphere temperature threshold value (NO in ACT 104), processing from ACT 110 to ACT 114 is executed. The threshold value temperature determination section 313 acquires the first Δtemperature (ACT 110). The threshold value temperature determination section 313 determines the abutting threshold value by adding the temperature measured by the thermopile sensor 308 and the first Δtemperature (ACT 111). The belt temperature sensor 391 measures the surface temperature of the end part of the endless belt 304 (ACT 112). The heat conduction member control section 314 determines whether or not the surface temperature of the end part of the endless belt 304 is smaller than the abutting threshold value (ACT 113).

If the surface temperature of the end part of the endless belt 304 is not smaller than the abutting threshold value (NO in ACT 113), the flow transits to the processing in ACT 115. If the surface temperature of the end part of the endless belt 304 is smaller than the abutting threshold value (Yes in ACT 113), the control section 311 determines whether or not the printing processing is ended (ACT 114). If the printing processing is ended (Yes in ACT 114), the processing is ended. If the printing processing is not ended (NO in ACT 114), the flow transits to the processing in ACT 103.

The heat conduction member control section 314 enables the pipe-shaped heat conduction member 305 to abut against the endless belt 304 (ACT 115). The heat conduction member control section 314 maintains that the pipe-shaped heat conduction member 305 abuts against the endless belt 304 (ACT 116). The control section 311 determines whether or not the printing processing is ended (ACT 117). If the printing processing is ended (Yes in ACT 117), the heat conduction member control section 314 separates the pipe-shaped heat conduction member 305 from the endless belt 304 (ACT 118). If the printing processing is not ended (NO in ACT 114), the flow transits to the processing in ACT 116.

In the image forming apparatus 100 constituted in this way, in a case in which the atmosphere temperature measured by the atmosphere temperature sensor 392 is under the atmosphere temperature threshold value, and a temperature difference between the temperature measured by the thermopile sensor 308 and the surface temperature of the end part of the endless belt is under the abutting threshold value, the heat conduction member control section 314 does not enable the pipe-shaped heat conduction member 305 to abut against the endless belt 304. Therefore, the decrease of the surface temperature of the endless belt 304 can be suppressed through the abutment of the pipe-shaped heat conduction member 305.

Further, in a case in which either the first temperature measurement sensor 309*a* or the second temperature measurement sensor 309*b* measures a temperature greater than or equal to the abutting threshold value, the heat conduction member control section 314 enables the pipe-shaped heat conduction member 305 to abut against the endless belt 304. The surface temperatures of the endless belt 304 are equalized, and the temperature increase of the non-paper passing part is suppressed due to the abutment of the pipe-shaped heat conduction member 305.

In the image forming apparatus 100 constituted in this way, the number of use of the thermopile sensor 308 of high cost can be minimized by using the temperature measurement sensor 309. Further, in a processing in which the printer section 130 prints media (for example, sheets) having a highly versatile size, the heat conduction member control section 314 can suppress an opportunity that the pipe-shaped heat conduction member 305 abuts against the endless belt 304. Furthermore, an image forming apparatus 100 which suppresses image defects or machine failure such as a high temperature offset caused by the increase of the surface temperature of the end part of the endless belt 304 can be provided.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a first temperature measurement sensor configured to measure a first temperature which is a surface temperature of an endless belt for fixing a developing agent adhering to a sheet;

a second temperature measurement sensor configured to measure a second temperature which is a surface temperature of an end part of the endless belt;

an atmosphere temperature measurement sensor configured to measure an atmosphere temperature which is a temperature around the image forming apparatus;

a threshold value temperature determination section configured to determine, on the basis of the atmosphere temperature and the first temperature, an abutting condition serving as a condition under which a heat conduction member for carrying out temperature equalization of the surface temperature of the endless belt abuts against the endless belt; and a heat conduction member control section configured to enable the heat conduction member to abut against the endless belt in a case in which the second temperature meets the abutting condition.

2. The image forming apparatus according to claim 1, wherein the threshold value temperature determination section determines the abutting condition by adding a temperature determined depending on the atmosphere temperature to the first temperature.

3. The image forming apparatus according to claim 2, wherein the threshold value temperature determination section determines the abutting condition by adding different temperatures to the first temperature in a case in which the atmosphere temperature is greater than or equal to an atmosphere temperature threshold value and in a case in which the atmosphere temperature is smaller than the atmosphere temperature threshold value.

4. The image forming apparatus according to claim 3, wherein the threshold value temperature determination section determines the abutting condition by adding 15 degrees centigrade to the first temperature in a case in which the atmosphere temperature is greater than or equal to the atmosphere temperature threshold value, and by adding 30 degrees centigrade to the first temperature in a case in which the atmosphere temperature is smaller than the atmosphere temperature threshold value.

5. The image forming apparatus according to claim 1, wherein the first temperature measurement sensor is arranged opposite to a central part of the endless belt in a longitudinal direction; and two second temperature measurement sensors and two atmosphere temperature sensors are arranged opposite to two end parts of the endless belt in the longitudinal direction.

6. The image forming apparatus according to claim 5, wherein the threshold value temperature determination section determines the abutting condition for each of the atmosphere temperatures measured by the two atmosphere temperature sensors; and the heat conduction member control section enables the heat conduction member to abut against the endless belt in a case in which one of the second temperatures measured by the two second temperature measurement sensors meets the abutting condition.

7. The image forming apparatus according to claim 1, wherein the first temperature measurement sensor measures the first temperature by a thermopile system.

8. The image forming apparatus according to claim 1, wherein the second temperature measurement sensor and the atmosphere temperature sensor measure the second temperature and the atmosphere temperature by a system using an infrared absorption difference.

9. The image forming apparatus according to claim 5, further comprising:

a light emitting filament configured to heat the surface of the endless belt, wherein the light emitting filament is arranged at the outside of an arrangement position of the second temperature measurement sensor in the longitudinal direction and at the inside of a maximum paper width of a passed sheet in the longitudinal direction; and the heat conduction member is arranged to the outside of the maximum paper width in the longitudinal direction.

10. An image forming method, comprising:

measuring, by an image forming apparatus, a first temperature indicating a surface temperature of an endless belt for fixing a developing agent adhering to a sheet;

measuring, by the image forming apparatus, a second temperature indicating a surface temperature of an end part of the endless belt;

measuring, by the image forming apparatus, an atmosphere temperature indicating a temperature around the image forming apparatus;

determining, on the basis of the atmosphere temperature and the first temperature, an abutting condition serving as a condition under which a heat conduction member for carrying out temperature equalization of the surface temperature of the endless belt abuts against the endless belt, by the image forming apparatus; and enabling, by the image forming apparatus, the heat conduction member to abut against the endless belt in a case in which the second temperature meets the abutting condition.

* * * * *